US009153857B2

(12) United States Patent
Teng

(10) Patent No.: US 9,153,857 B2
(45) Date of Patent: Oct. 6, 2015

(54) METHOD FOR ENHANCING SIGNAL STRENGTH IN MOBILE COMMUNICATION DEVICE

(71) Applicant: Chih-Hao Teng, Taipei (TW)

(72) Inventor: Chih-Hao Teng, Taipei (TW)

( * ) Notice: Subject to any disclaimer, the term of this patent is extended or adjusted under 35 U.S.C. 154(b) by 405 days.

(21) Appl. No.: 13/677,485

(22) Filed: Nov. 15, 2012

(65) Prior Publication Data

US 2014/0132458 A1 May 15, 2014

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243; H01Q 1/38; H01Q 9/04921
USPC ..... 343/702, 872, 878
See application file for complete search history.

(56) References Cited

U.S. PATENT DOCUMENTS

| | | | | |
|---|---|---|---|---|
| 2001/0050637 | A1* | 12/2001 | Aoyama et al. | 343/700 MS |
| 2008/0166004 | A1* | 7/2008 | Sanford et al. | 381/375 |
| 2009/0273521 | A1* | 11/2009 | Wong et al. | 343/700 MS |
| 2010/0277377 | A1* | 11/2010 | Sato et al. | 343/702 |
| 2011/0018773 | A1* | 1/2011 | Hikino | 343/702 |
| 2011/0169699 | A1* | 7/2011 | Huang | 343/702 |

* cited by examiner

*Primary Examiner* — Dameon E Levi
*Assistant Examiner* — Collin Dawkins
(74) *Attorney, Agent, or Firm* — Lin & Associates IP, Inc.

(57) ABSTRACT

A signal-strength enhancing structure for use in a mobile communication device, includes a mobile casing having an accommodation plate for receiving the mobile communication device thereon and a lateral portion extending outwardly from a periphery confining the accommodation plate to enclose the mobile communication device at least partially once placed on the accommodation plate; and a metal element connected to the mobile communication device via a gap-coupled device.

4 Claims, 6 Drawing Sheets

METHOD FOR ENHANCING SIGNAL STRENGTH IN MOBILE COMMUNICATION DEVICE

BACKGROUND OF THE INVENTION

1. Field of the Invention

The present invention relates to a method for enhancing signal strength of a wireless signal, more particularly to a structure and method for enhancing signal strength of a wireless signal in a mobile communication device.

2. The Prior Arts

A mobile phone is generally used for communication with another person far away from the user. Due to rapid advance in the electronic technology, the mobile phone has exceeded the purpose of personal communication between two persons. The functions of mobile phone increase as day gone by, and the most distinct function with respect to the conventional mobile phone is that the mobile phone of nowadays can be connected wirelessly to the Internet so that the user can browse or surf a desired network via the mobile phone. Of course, the antenna unit of the mobile phone is used for transmitting and receiving wireless signals, which are later processed by a chip installed in the mobile phone in order to execute a task. In addition, some Bluetooth-enabled mobile phone can wirelessly transmit or receive data or messages using Bluetooth protocol. Hence, the signal reception quality of the antenna unit in one mobile phone determines the fast or slow surfing and transmission speed of the data.

Presently, several types of mobile phone protection shells are available in the market. Some simply provides protection against collision or wearing. Others provide not only protection but also aesthetic and beautiful appearance. However, the materials from which these protection shells are made or the designs more or less affect the signal transmission and reception quality of the antenna unit. Under such a condition, it is highly desirable to search a method for fabricating a phone protection shell, which can not only protect the mobile phone but can also enhance signal strength of a wireless signal in the mobile phone.

SUMMARY OF THE INVENTION

Therefore, an objective of the present invention is to provide a method and signal-strength enhancing structure for enhancing the signal-strength of wireless signals for wireless communication devices. The wireless communication devices include a mobile phone, a wireless communication apparatus, Bluetooth-enabled communication devices and other communication apparatuses. While using the mobile phone installed with the signal-strength enhancing structure of the present invention via the gap-coupled means, and if the user feels the surfing or reception of wireless signals is not sufficiently enough, he can alter and enhance the signal strength of the wireless signal of the antenna unit, surfing a desired network or transmission and reception of wireless signals.

In the present invention, one metal element is utilized for connection to a mobile communication device or a pull strip is utilized for connection to a mobile protection shell in such a manner that the metal element is mounted on the pull strip to be movable together therewith. While using the mobile phone installed with the mobile casing of the present invention via the gap-coupled means, and if the user feels the surfing or reception of wireless signals is not sufficiently enough, he can extend the pull strip outward to a certain degree, under which the metal plate on the pull strip alters and enhances the signal strength of the wireless signal transmitted or received by the antenna unit of the mobile phone.

The metal element is connected to the antenna unit of the mobile phone via gap-coupled means in such a manner that the gap between the antenna unit and the metal element serves as series connection between capacitors, thereby altering frequency effect (such as resonance frequency) of an antenna unit. It is to state that the antenna unit and the metal element are critically coupled to each other so as to achieve the ultimate frequency efficiency and rate for signal transmission and reception. The metal element can be directly mounted on the mobile phone. Alternately, the metal element is mounted slidably on the mobile protection shell via a pull strip. It can be designed in such a way that the pull strip slides on the mobile protection shell. Due to variation of distance between the antenna unit and the metal element, the series connection effect is also varied to alter the frequency efficiency of the antenna unit in the mobile phone.

In accordance with the method of the present invention, at least one metal element is utilized for connection to a mobile phone via gap-coupled means in order to alter frequency effect of an antenna unit installed on the mobile communication device, wherein, after connection, the metal element has at least an area overlapped with the mobile phone.

In another aspect of the invention, the gap-coupling means includes a step of directly connecting the metal element to the mobile phone or a mobile protection shell of the mobile phone.

The signal-strength enhancing structure of the present invention can be implemented in a mobile phone, and includes a mobile casing having an accommodation plate for receiving the mobile phone thereon and a lateral portion extending outwardly from a periphery confining the accommodation plate so as to enclose the mobile phone at least partially once the mobile phone is placed on the accommodation plate; and at least one metal element is connected to the mobile casing via a gap-coupled means.

The metal plate can be directly connected to the mobile phone or the mobile casing. Alternately, in other embodiments, the metal plate can be connected to the mobile phone or the mobile casing (mobile phone protection shell) via a pull strip. The mobile casing is preferably formed with a slide groove for receiving the pull strip. The pull strip has an inner side surface facing the mobile phone and an outer side surface opposite to the inner side surface. The metal element is mounted on one of the inner and outer side surfaces of the pull strip, thereby movable together with the pull strip with respect to the accommodation plate. In addition, the accommodation plate of the mobile casing is further formed with an exposure opening. The mobile casing further includes a lateral portion extending outwardly from a periphery confining the accommodation plate. The lateral portion of the accommodation plate is further formed with at least one lateral opening.

In the present invention, the metal element has a configuration of any shape such that the same can be implemented in a mobile phone of any brand or produced by any manufacturing company.

The signal-strength enhancing structure of the present invention can be implemented in a mobile phone of any shape and brand. The formation of a retention recess for receiving the metal element and the pull strip should complement to the configuration of the antenna unit, so long as the antenna unit can enhance the signal strength of the received wireless signal. Formation of the retention recess and the pull strip should not be restricted to any position and configuration.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
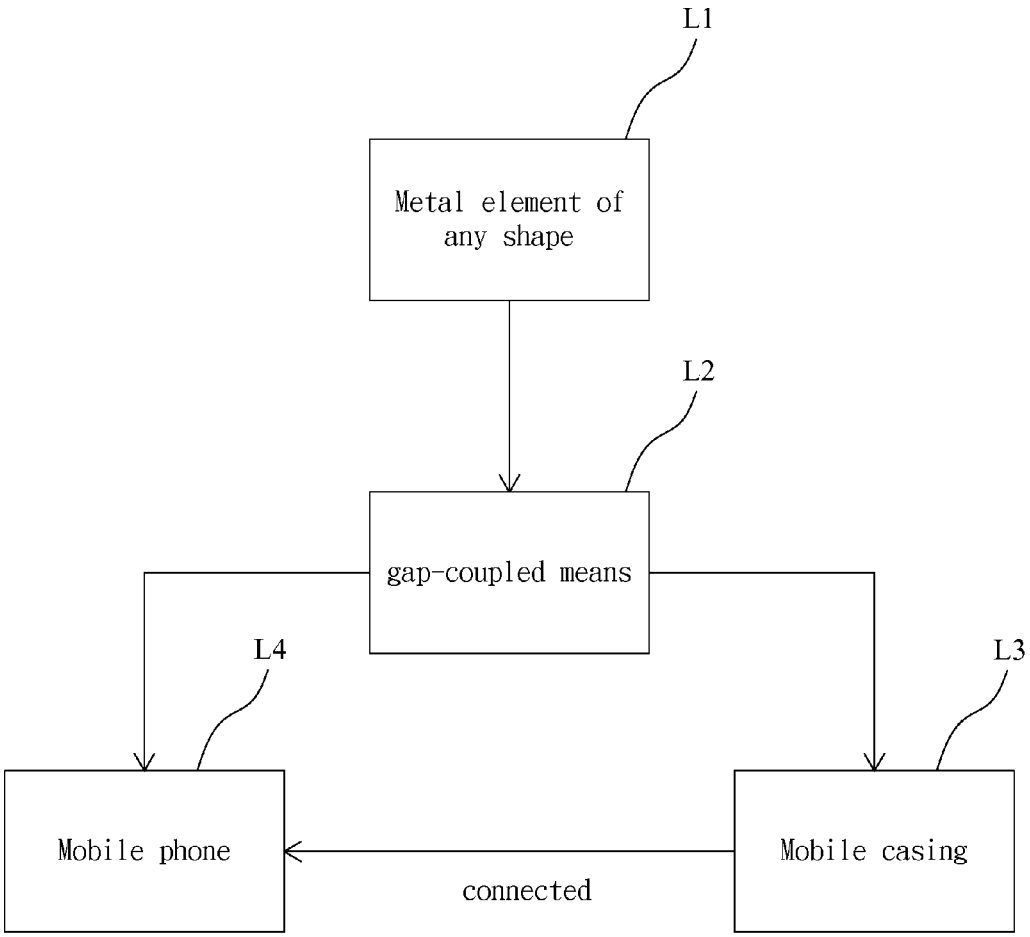
FIG. 1 shows a block diagram of a method for enhancing signal strength of a wireless signal in a mobile communication device in accordance with the present invention.

FIG. 1 shows a block diagram of a method for enhancing signal strength of a wireless signal in a mobile communication device in accordance with the present invention. In accordance with the present invention, a metal element L1 of any configuration or shape is utilized and is connected to one mobile communication device L4 (later mobile phone) via gap-coupled means L2 in order to alter frequency effect of an antenna unit installed in the mobile phone for enhancing signal strength of a wireless signal transmitted or received by the mobile phone L4. The gap-coupling means L2 includes a step of directly connecting the metal element to the mobile phone L4. Preferably, the mobile phone L4 further includes a mobile casing (mobile protection casing) L3. The gap-coupling means L2 includes a step of connecting the metal element L1 to the mobile casing L3, hence the metal element L1 is connected to the mobile phone L4.

Figure 2A:
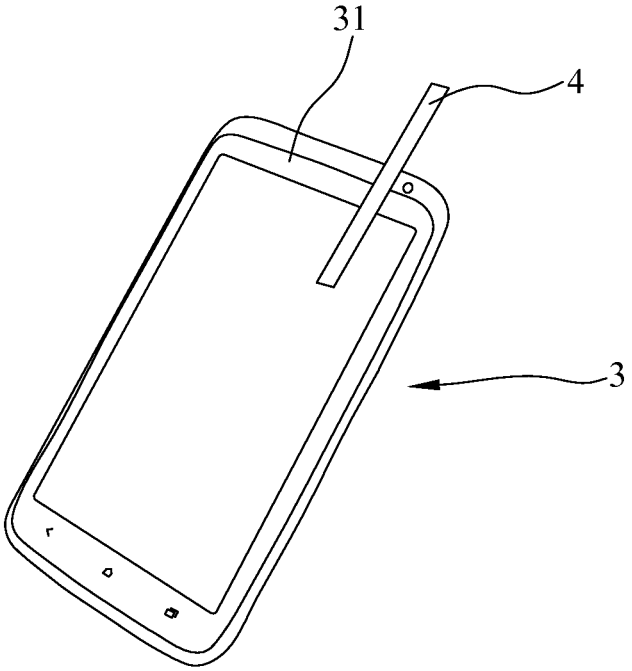
FIG. 2A is a perspective view illustrating how a metal element is mounted directly on the mobile communication device in accordance with the present invention in a first way.
Figure 2B:
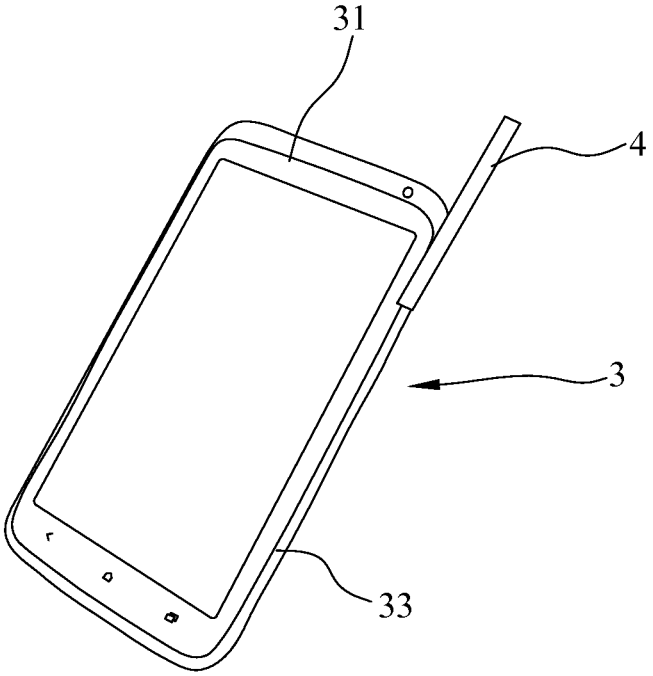
FIG. 2B is a perspective view illustrating how the metal element is mounted directly on the mobile communication device in accordance with the present invention in a second way.
Figure 2C:
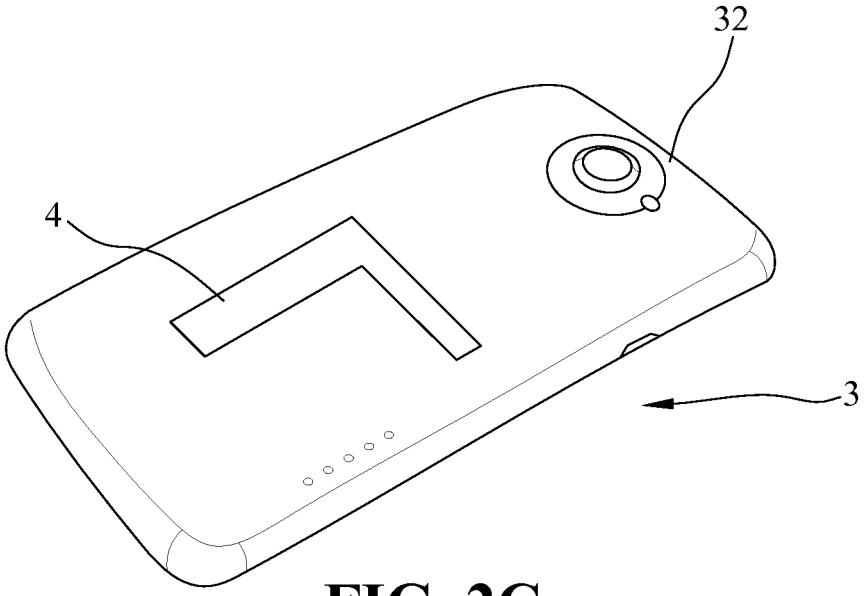
FIG. 2C is a perspective view illustrating how the metal element is mounted directly on the mobile communication device in accordance with the present invention in a third way.
Figure 2D:
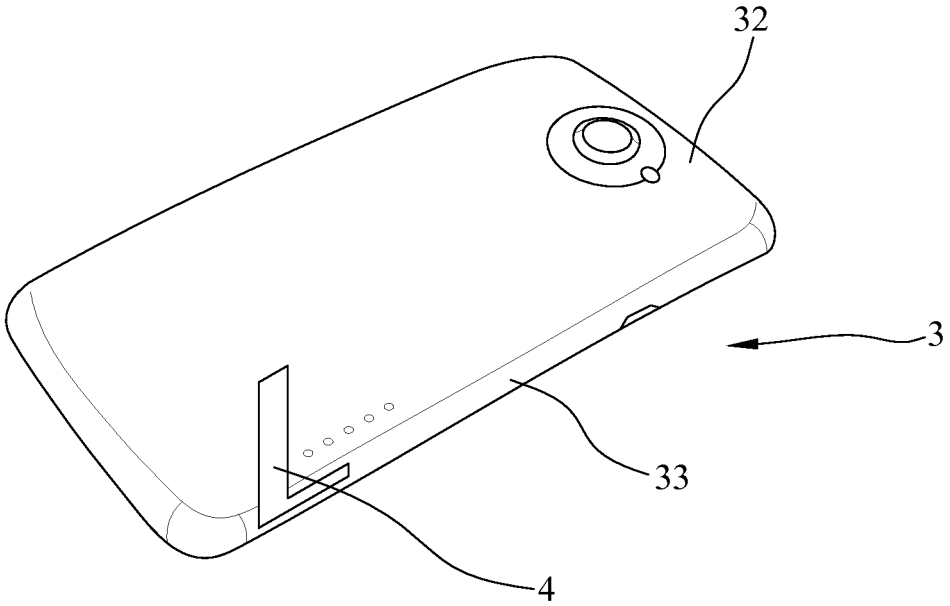
FIG. 2D is a perspective view illustrating how the metal element is mounted directly on the mobile communication device in accordance with the present invention in a fourth way.

Referring to FIGS. 2A-2D, wherein FIG. 2A is a perspective view illustrating how the metal element, in the form of an elongated metal plate 4 with rectangular cross-section, is mounted directly on the front surface 31 of the mobile phone 3 near the upper right side thereof in accordance with the present invention in a first way; FIG. 2B is a perspective view illustrating how the elongated metal plate 4 is mounted directly on a lateral side surface 33 of the mobile phone 2 in accordance with the present invention in a second way; FIG. 2C is a perspective view illustrating how the elongated metal plate 4 is mounted directly on the rear surface 32 of the mobile phone 3 near the lower left side thereof in accordance with the present invention in a third way; and FIG. 2D is a perspective view illustrating how an L-shaped metal plate 4 is mounted directly on the lateral side surface 33 of the mobile phone 3 in accordance with the present invention in a fourth way. Note that mounting of the metal plate 4 on the mobile phone 3 can be accomplished via adhesion means, but should not be limited only thereto. Another factor to note is that after connection or assembly, the metal plate 4 has at least an area overlapped with the mobile phone 3. The metal plate 4 or metal rod may have a cylindrical cross-section or a rectangle but the shape should not be limited to any configuration.

In those embodiments illustrated in FIGS. 2A-2D, the metal plate 4 may have a configuration or any shape and can be connected to any position of the mobile phone 3. The scope of the present invention should not be limited to the above four embodiments only. The mobile phone 3 can be of any brand or type and is produced from any manufacturing company. The materials for fabrication of the mobile phone and the mobile casing generally include plastic materials and metals in the present invention.

The metal plate L1 of any configuration or shape is mounted to the mobile phone L4 or the mobile casing L3 via the gap-coupled means 2 in those embodiments. The metal plate 4 can be directly connected to the mobile phone or the mobile casing. Alternately, in other embodiments, the metal plate 4 can be connected to the mobile phone or the mobile casing (mobile phone protection shell) via a pull strip 2, as best shown in FIGS. 3A and 3B, where the mobile casing is formed with a slide groove for receiving the pull strip in such a manner that the pull strip is extendible slidably, outwardly from and retractable into the mobile casing so as to adjust the transmitting and receiving frequency of the antenna unit installed in the mobile phone.

Figure 3A:
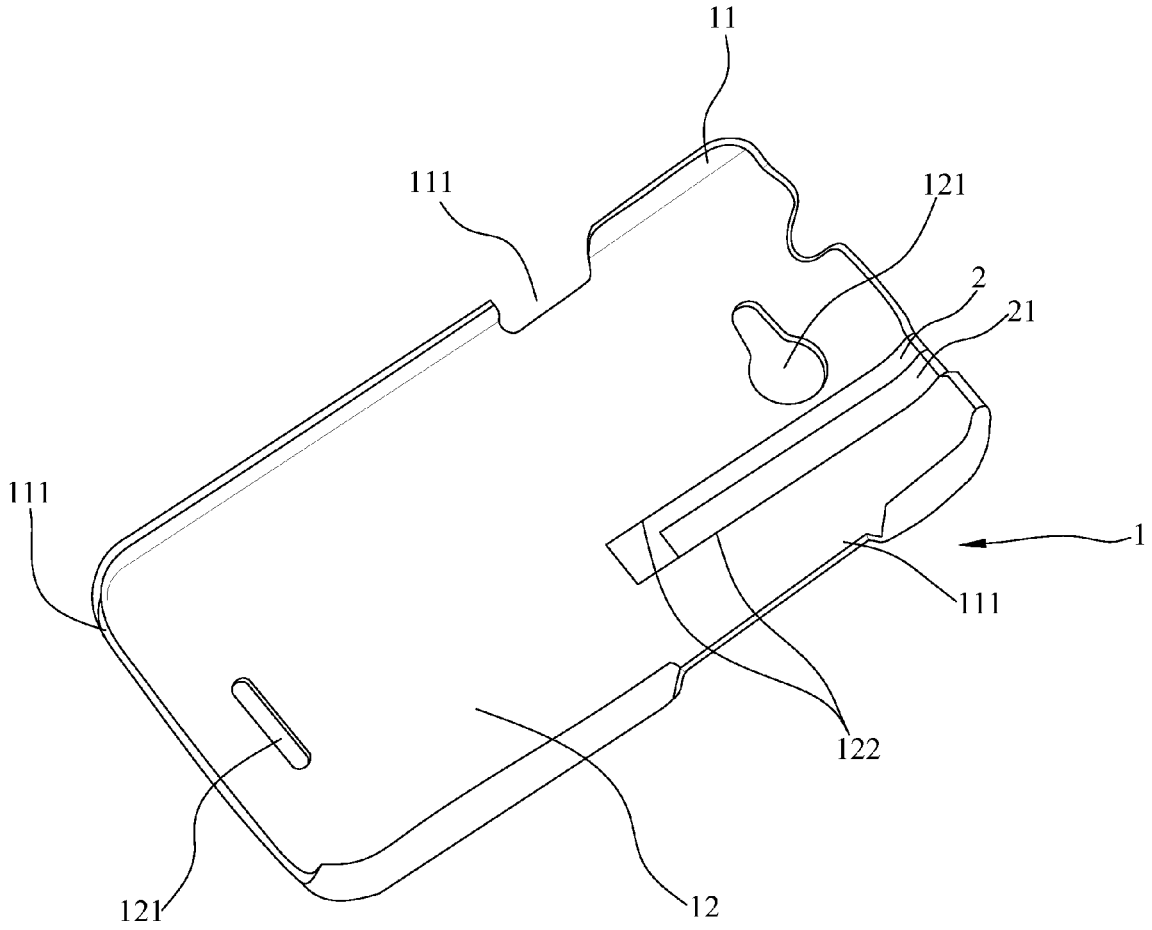
FIG. 3A is a perspective view illustrating how the metal element is mounted on a mobile phone protection shell in accordance with the present invention in a first way.
Figure 3B:
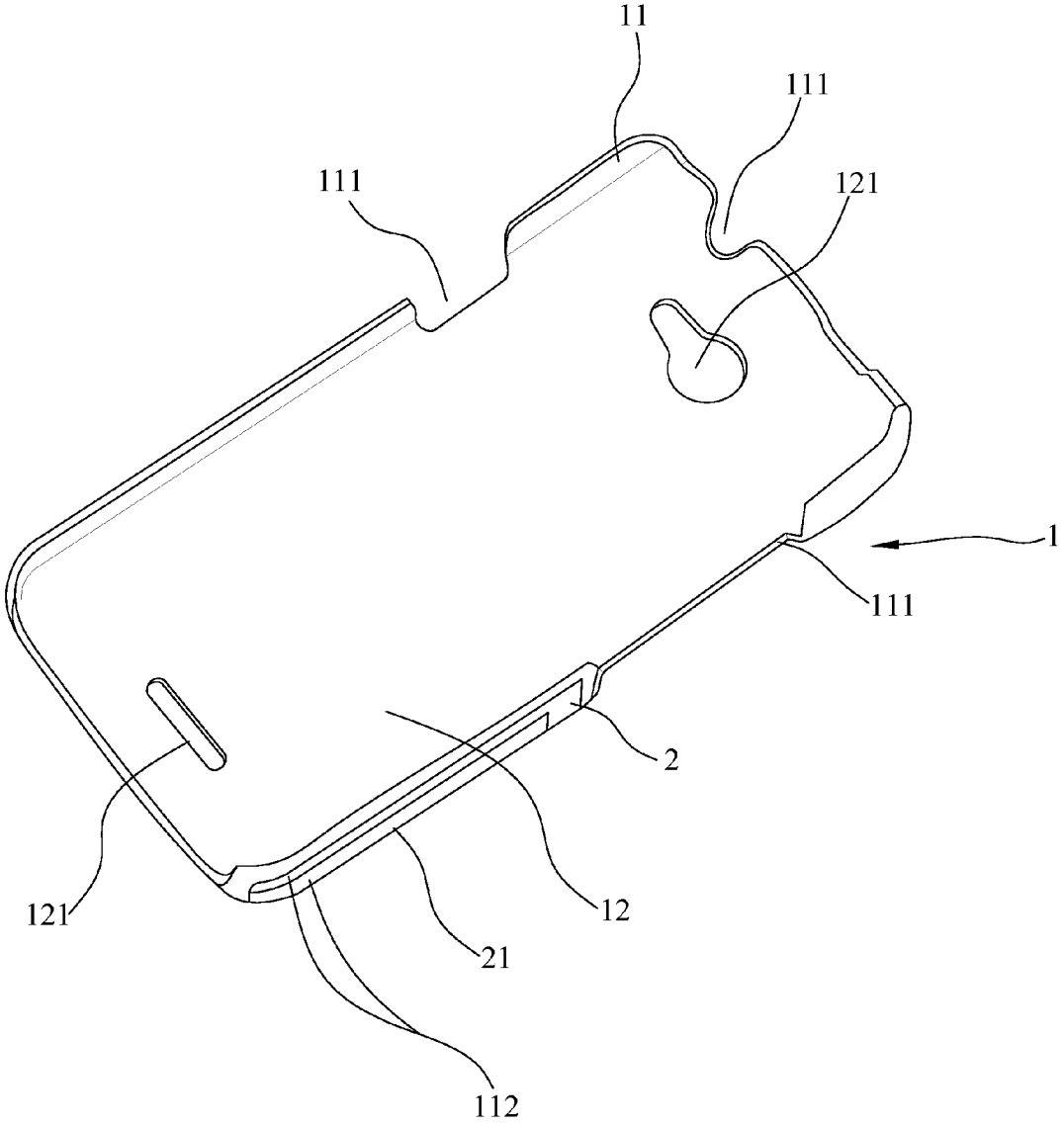
FIG. 3B is a perspective view illustrating how the metal element is mounted on the mobile phone protection shell in accordance with the present invention in a second way.

FIG. 3A is a perspective view illustrating how the metal plate is mounted on the mobile casing in accordance with the present invention in a first way. The mobile phone 1 preferably includes the mobile casing (mobile phone protection shell), which has an accommodation plate 12 for receiving the mobile phone thereon and a lateral portion 11 extending outwardly from a periphery confining the accommodation plate 12 so as to enclose and surround the mobile phone at least partially once the mobile phone is placed on the accommodation plate 12.

The accommodation plate 12 of the mobile casing is further formed with an oblong opening at an upper portion thereof. The oblong opening is confined by two opposite side walls cooperatively defining a slide groove structure 122. The accommodation plate 12 of the mobile casing is further formed with an exposure opening 121 at a lower portion thereof; that extends along a direction transverse to the slide groove structure 122 and that exposes the view finding window (see FIGS. 2C and 2D) of a camera device in the mobile phone after assembly of the mobile casing and the mobile phone.

The lateral portion 11 of the accommodation plate 12 is further formed with two lateral openings 111 such that after assembly of the mobile casing with the mobile phone, a portion (including volume-control key, suspending key, earphone socket and charging hole) of the mobile phone is exposed to facilitate the user to operate the respective operation key.

Note that formation of the exposure opening 121 and the lateral opening 111 in the accommodation plate 12 should be conducted in such a way to complement with the components of the mobile phone, such as the camera lens, earphone socket and charging hole. However, if the mobile phone fabricated by the method of the present invention is not equipped with above-stated widgets, formation of the exposure opening 121 and the lateral opening 111 in the accommodation plate 12 can be neglected.

The pull strip 2 is mounted slidably in the slide groove structure 122, and has a planar inner side surface facing the mobile phone and a planar outer side surface opposite to the inner side surface. In this embodiment, the metal plate 21 is mounted on one of the inner and outer side surfaces of the pull strip 2, thereby movable together with the pull strip 2 with respect to the accommodation plate 12 of the mobile casing. Alternately, the metal plate 21 can be embedded within the pull strip 2 so as to be movable together therewith. Mounting of the metal plate 21 on the pull strip 2 is accomplished via the adhesive means, but the scope should not be limited only thereto.

FIG. 3B is a perspective view illustrating how the metal plate 21 is mounted on the accommodation plate 12 of the mobile casing in accordance with the present invention in a second way, wherein the lower portion of the accommodation plate 12 is formed with the lateral portion 11 enclosing or surrounding the periphery of the accommodation plate 12.

The accommodation plate 12 of the mobile casing is further formed with an exposure opening 121 at upper and lower portions thereof so that after assembly of the mobile casing and the mobile phone, the view finding window (see FIGS. 2C and 2D) of a camera device in the mobile phone is exposed to an exterior environment.

The lateral portion 11 of the accommodation plate 12 is formed with an oblong opening at the lower portion thereof. The oblong opening is confined by two opposite side walls cooperatively defining the slide groove 112. The lateral portion 11 of the accommodation plate 12 is further formed with two lateral openings 111 at the upper portion thereof such that after assembly of the mobile casing and the mobile phone, a portion (including volume-control key, suspending key, earphone socket and charging hole) of the mobile phone is exposed to the exterior to facilitate the user to operate the respective key.

The pull strip 2 is mounted slidably in the slide groove 112, and has a planar inner side surface facing the mobile phone and a planar outer side surface opposite to the inner side surface. In this embodiment, the metal plate 21 is mounted on the outer side surface of the pull strip 2, thereby movable together with the pull strip 2 with respect to the accommodation plate 12 of the mobile casing. Mounting of the metal plate 21 on the pull strip 2 is accomplished via the adhesive means, but the scope should not be limited only thereto.

FIGS. 3A and 3B illustrate two embodiments of metal plate mounting method relative to the mobile casing, but the scope should not be limited only to the two methods. The mounting of metal plate relative to the pull strip should not be limited to any specific side surface and position. Alternately, the pull strip 2 can be formed with a retention recess, into which the metal plate is attached thereinto. An auxiliary metal plate is used for shielding the pull strip 2 in such a manner that the pull strip 2 is not visible from an exterior environment. In addition, the pull strip 2 is designed to be slidable to couple with the antenna to achieve the ultimate frequency efficiency and rate. Hence, the pull strip is not always designed as slidable. For instance, the metal plate 21 can be directly mounted on the mobile casing without the need of the pull strip in order to achieve the ultimate frequency efficiency also.

While using the mobile phone installed with the mobile casing of the present invention via the gap-coupled means, and if the user feels the surfing or reception of wireless signals is not sufficiently enough, he can extend the pull strip 2 outward to a certain degree, under which the metal plate 21 on the pull strip 2 alters and enhances the signal strength of the wireless signal transmitted or received by the antenna unit of the mobile phone. The enhancing signal strength of received wireless signal may be achieved in some mobile phone of other type without the need of extending the pull strip outward from the mobile casing.

In order to achieve the ultimate frequency efficiency, the formation of the retention recess and the pull strip should complement to the configuration of the antenna unit. As described above, so long as the antenna unit can enhance the signal strength of the received wireless signal, formation of the retention recess and the pull strip should not be restricted to any position and configuration.

Figure 4:
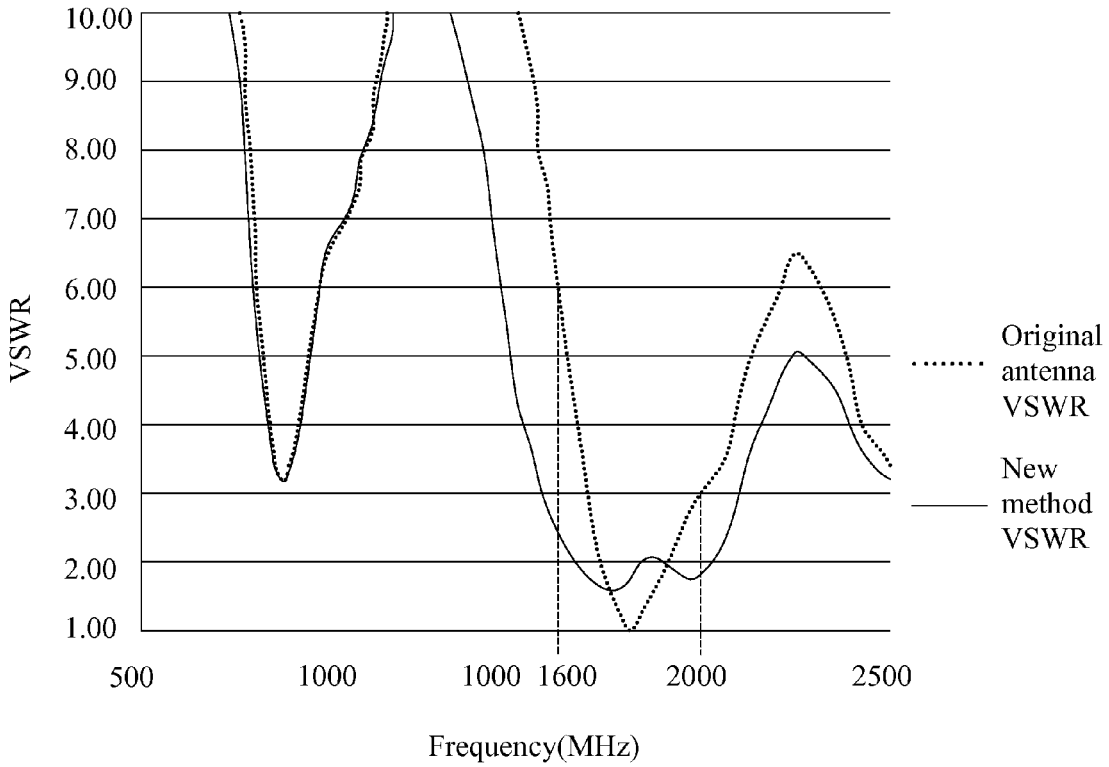
FIG. 4 shows a graph illustrating the VSWR (Voltage Standing Wave Ratio) and MHz (Frequency) of the prior art mobile communication device in comparison to the mobile communication device fabricated by the method of the present invention.

In wireless signal transmission, VSWR (Voltage Standing Wave Ratio) unit is used to measure the impedance in transmission line, and is represented by X:1; or simply X. The smaller the value of X becomes (i.e. when the value of X approaches 1), the lesser the reflected wave power in the transmission cable. In short, an ideal transmission line has SWR 1:1. To prove the enhanced signal strength in a mobile phone provided with the signal-strength enhancing structure of the present invention relative to a conventional mobile phone, an experiment is conducted and the result is shown in FIG. 4, wherein the graph shows VSWR vs. Frequency of the prior art and present mobile phones. As illustrated in FIG. 4, when operated under any frequency range, the prior art mobile phone generates VSWR higher than a mobile phone provided with the signal-strength enhancing structure of the present invention. For instance, when operating under frequency range of 1600 MHz, the present mobile phone has 2-3 lesser VSWR when compared with the prior art mobile, which has 6 VSWR. When operating under frequency range of 2000 MHz, the present mobile phone has 1.9 VSWR while the prior art mobile has 3 VSWR.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A signal-strength enhancing structure adapted to be implemented together with a mobile communication device, comprising:

a mobile casing including an accommodation plate for receiving the mobile communication device thereon and a lateral portion extending outwardly from a periphery confining said accommodation plate so as to enclose the mobile communication device at least partially once said mobile communication device is placed on said accommodation plate; and at least one metal element connected to said mobile communication device via a gap-coupled means;

wherein said accommodation plate of said mobile casing is further formed with a slide groove and an exposure opening, the signal-strength enhancing structure further comprises a pull strip mounted slidably in said slide groove so as to be extendible outwardly from and retractable into said accommodation plate, said pull strip has an inner side surface facing the mobile communication device and an outer side surface opposite to said inner side surface, said metal element is mounted on one of said inner and outer side surfaces of said pull strip, thereby movable together with said pull strip with respect to said accommodation plate, and said lateral portion of said accommodation plate is formed with a lateral opening for exposing a portion of the mobile communication device.

2. The signal-strength enhancing structure according to claim 1, wherein said metal element is mounted on said inner side surface of said pull strip.

3. The signal-strength enhancing structure according to claim 1, wherein said metal element is mounted on said outer side surface of said pull strip.

4. The signal-strength enhancing structure according to claim 1, wherein said metal element is connected to said inner side surface of said pull strip.

* * * * *